United States Patent [19]

Hynek et al.

[11] Patent Number: 4,465,456

[45] Date of Patent: Aug. 14, 1984

[54] VARIABLE FIRING RATE BURNER

[75] Inventors: Scott J. Hynek, Dover; Philip Dantowitz, Peabody; Henry H. Fuller, Waban, all of Mass.

[73] Assignee: Foster-Miller Inc., Waltham, Mass.

[21] Appl. No.: 295,574

[22] Filed: Aug. 24, 1981

[51] Int. Cl.[3] ..... F23N 5/00

[52] U.S. Cl. ..... 431/62; 431/90; 431/354; 137/98; 236/15 BD

[58] Field of Search ..... 431/62, 90, 265, 354; 137/98, 625.4, 625.44; 239/61; 126/351; 236/15 BD

[56] References Cited

U.S. PATENT DOCUMENTS

| | | | |
|---|---|---|---|
| 3,371,699 | 3/1968 | Riot | 431/354 |
| 3,797,989 | 3/1974 | Gordon | 431/90 |
| 3,827,849 | 8/1974 | Nelson | 431/90 |
| 4,396,371 | 8/1983 | Lorenz et al. | 236/15 BD |

FOREIGN PATENT DOCUMENTS

| | | | |
|---|---|---|---|
| 0046323 | 4/1980 | Japan | 431/354 |

*Primary Examiner*—Samuel Scott
*Assistant Examiner*—Margaret A. Focarino

[57] ABSTRACT

A variable firing rate burner with a throttle valve assembly that regulates fuel and air intake while maintaining a substantially constant fuel/air ratio over a wide fuel/air flow rate range. The throttle valve assembly includes a pivotally mounted throttle plate that seats on an input manifold, the throttle plate being moved by a driver between low and high firing rate positions. Fuel and air are drawn through the throttle valve assembly and into a mixing chamber by a blower and directed to a flameholder where ignition occurs.

11 Claims, 3 Drawing Figures

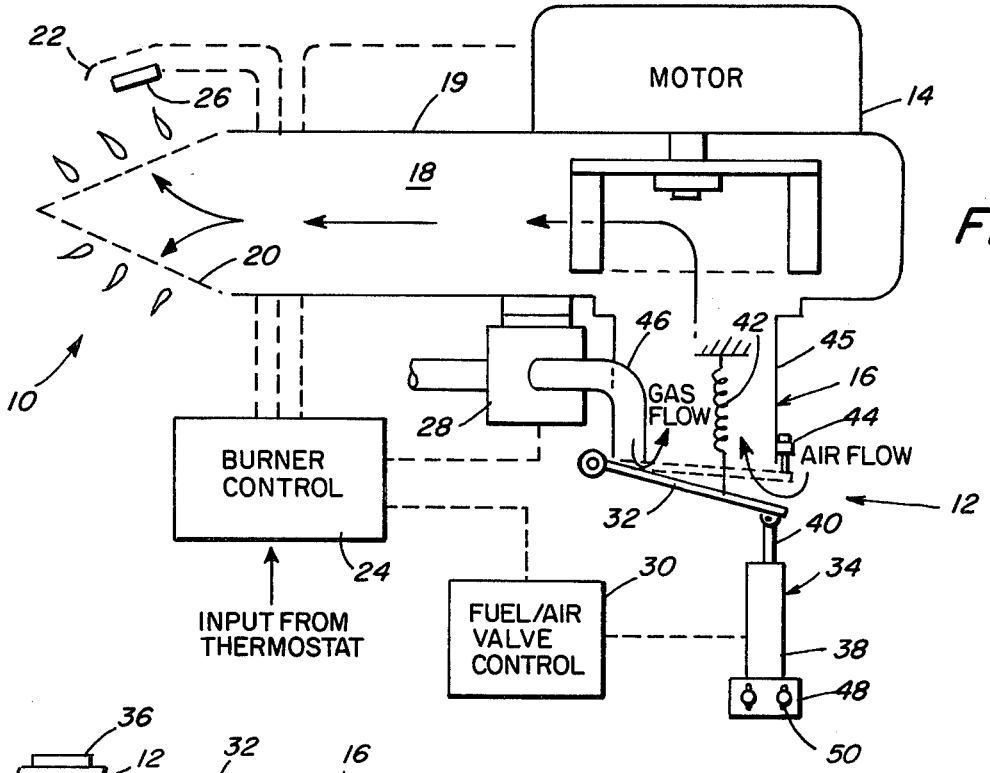
FIG. 1
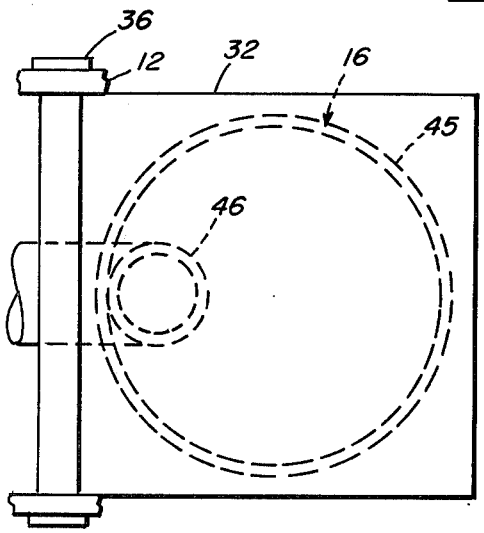
FIG. .2
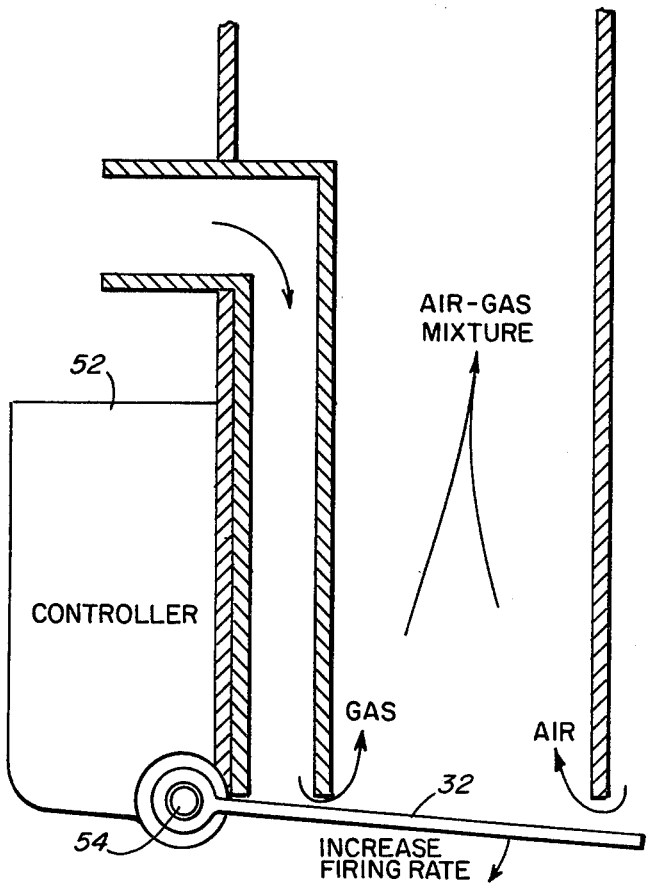
FIG. 3

VARIABLE FIRING RATE BURNER

BACKGROUND OF THE INVENTION

1. Field of the Invention

The present invention relates to space and hydronic heating systems and, more particularly, is directed towards a burner for such systems.

2. Description of the Prior Art

In gas fired furnaces, gas and air are drawn into a mixing chamber by a blower and directed to a combustion chamber for burning. A common method of controlling the gas/air ratio is by means of a sliding member which covers an opening through which both gas and air flow. The sliding member is adjusted so as to provide a fixed firing rate at which maximum combustion efficiency occurs. Such systems suffer from the disadvantage that a fixed firing rate results in a limited system efficiency.

SUMMARY OF THE INVENTION

It is an object of the present invention to provide a heating system which does not suffer from the heretofor mentioned disadvantages.

Another object of the present invention is to provide a space and hydronic heating system of relatively high efficiency.

A further object of the invention is to provide a variable firing rate burner for space and hydronic heating systems. The variable firing rate burner is characterized by a throttle valve assembly that regulates fuel and air intake while maintaining a substantially constant fuel-/air ratio over a wide range of fuel/air flow rates. The throttle valve assembly includes a pivotally mounted throttle plate that is moved by a driver between low and high firing rate positions. Fuel and air are drawn through an open ended manifold by a blower assembly, the opened end of the manifold being a valve seat for the throttle plate. The manifold constitutes an air inlet conduit through which air flows. A gas inlet conduit is mounted tangentially within the air inlet conduit. The pivot point of the throttle plate is at the end of the air inlet conduit adjacent the point of tangency. Fuel and air entering the manifold are drawn by the blower assembly into a mixing chamber and directed toward a combustion chamber. The fuel/air mixture flows through a flameholder and is ignited by an ignitor. In one embodiment of the invention, the driver is operative to move the throttle plate in a multitude of positions between the low and high firing rate positions. In an alternative embodiment, the driver is operative to move the throttle plate only to a low firing rate position and to a high firing rate position.

Other objects of the present invention will in part be obvious and will in part appear hereinafter. The invention accordingly comprises the apparatus, together with its parts, elements and interrelationships that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein:

FIG. 1 is a block and schematic diagram of a variable firing burner embodying the present invention;

FIG. 2 is an end view of the input manifold of FIG. 1; and

FIG. 3 is an alternative embodiment of the throttle valve of FIG. 1.

DESCRIPTION OF THE PREFERRED EMBODIMENTS

Referring now to the drawings, particularly FIG. 1, there is shown a combustion system 10 for space and hydronic heating systems. As hereinafter described, combustion system 10 is characterized by a variable firing rate burner with a throttle valve assembly 12 that regulates fuel and air intake while maintaining a substantially constant fuel/air ratio over a wide range of fuel/air flow rates. Fuel, for example propane or natural gas, and air are drawn by a blower 14 through a manifold 16 and into a mixing chamber 18 formed in a housing 19. Throttle valve 12 regulates the flow of fuel and air through manifold 16. The fuel/air mixture passes through a flameholder 20 mounted to housing 19. In the illustrated embodiment, by way of example, housing 19 has a substantially cylindrical profile and flameholder 20 is a perforated cap with a series of holes defining a sieve-like structure having a substantially conically shaped profile. An ignitor 22, which is regulated by a burner control 24, ignites the fuel/air mixture passing through the flameholder. A flame sensor 26 is positioned between ignitor 22 and flameholder 20. In the embodiment of FIG. 1, gas from a supply is fed into input manifold 12 through a negative pressure or zero regulator 28 so that both the gas and air entering manifold 16 are at the same pressure, namely atmospheric pressure, and are drawn into blower 14 by the blower's suction head. Burner control 24 receives input signals from a thermostat (not shown) and flame sensor 26, and controls the operation of blower 14, ignitor 22 and a fuel/air valve control 30 which governs the operation of throttle valve 12.

Throttle valve 12 includes a throttle plate 32, one end of which is operatively connected to a driver 34. The other end of throttle plate 32 is pivotally connected to manifold 16 via a pin 36, for example. Driver 34, for example a solenoid having energized and de-energized states, includes a cylinder 38 and a reciprocating piston 40. When driver 34 is actuated to its energized state by fuel/air control 30, piston 40 is retracted into cylinder 38 and throttle plate 32 is moved to a high firing rate position (a high fuel/air flow rate). When driver 34 is de-energized, throttle plate 32 is moved to a low firing rate position (a low fuel/air flow rate) by a biasing element 42, for example a spring. An adjusting member 44, for example a screw, sets the return or low firing rate position of throttle plate 32.

As shown in FIG. 2, manifold 16 includes an air inlet conduit 45 and a gas inlet conduit 46. Gas conduit 46 is connected to negative pressure regulator 28 and mounted tangentially within air inlet conduit 45. Throttle plate 32 is mounted to manifold 16 adjacent the point of tangency of gas inlet conduit 46 and air inlet conduit 45. The outermost edges of air inlet conduit 45 and gas inlet conduit 46 are disposed in a common plane and define a valve seat for throttle valve 16. As previously indicated, driver 34 is operative to move throttle plate 16 between a high firing rate position and a low firing rate position, the low firing rate position being set by the position of screw 44. The high fuel position of throttle plate 32 is adjusted by moving cylinder 38 relative to a bracket 48 having elongated holes 50, driver 34 being mounted to bracket 48. In the illustrated embodiment, fuel/air valve control 30 is a dual position aquastat which measures hydronic boiler temperature and throttle plate 32 is moved between a high firing rate position and a low firing rate position.

In one embodiment, aquastat 30 is a dual set aquastat having a primary or high boiler setpoint in the range of 120° F. to 160° F., preferably 140° F. and a secondary or low boiler setpoint in the range of 100° F. to 140° F., preferably 120° F. Combustion system 10 is turned ON and OFF by aquastat 30. When the hydronic boiler temperature falls below the primary setpoint, combustion system 10 is turned ON at the low firing rate by aquastat 30. When the hydronic boiler temperature falls below the secondary setpoint, aquastat 30 actuates solenoid 38 and combustion system 10 is turned ON at the high firing rate. In an alternative embodiment, as shown in FIG. 3, throttle plate 32 is operatively connected to a controller 52, for example a motor, in such a manner that the throttle plate is movable between a high firing rate position and a low firing rate position. Throttle plate 32 is connected to a shaft 54 of motor 52, for example a stepping motor, and is movable in a plurality of positions between the high firing rate and low firing rate positions.

In both embodiments of the invention, throttle valve assembly 12 controls the quantity of fuel and air that is drawn into mixing chamber 18. The pivot point of throttle plate 32 is on the edge of the valve seat so as to provide a particular fuel/air ratio without using an inordinately large air conduit or small gas conduit. In the illustrated embodiment, air inlet conduit 45 has an outside diameter of 2.125 inches and the outside diameter of gas inlet conduit 46 is 0.5 inches. The dimensions of air inlet conduit 45 and gas inlet conduit 46 are selected to provide a fuel/air ratio of approximately 1 to 10. The mounting arrangement of throttle plate 32 is such that a substantially constant fuel/air ratio is maintained over a flow rate change of approximately 10 to 1.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A variable firing rate burner comprising:

(a) inlet means through which fuel and air flow, said inlet means including gas inlet means and air inlet means, said gas inlet means disposed within said air inlet means;

(b) valve means for controlling fuel/air ratio and the flow rate of said fuel and air flowing in said inlet means, said valve means movable between a first position and a second position, said fuel/air flow rate being greater at said second position than at said first position, said fuel/air ratio being maintained as said valve means is moved from said first position to second position;

(c) control means operatively connected to said valve means for moving said valve means to at least said first and second position;

(d) a chamber wherein said fuel and air are mixed; and (e) means for igniting said fuel and air mixture;

(f) said air inlet means being air inlet conduit means and said gas inlet means being gas inlet conduit means, said valve means including a throttle plate, said gas inlet conduit means being tangentiallly mounted within said air inlet conduit means, said throttle plate being pivotally mounted to said inlet means adjacent the point of tangency of said gas inlet conduit means and said air inlet conduit means, outer edges of said air inlet conduit means and said gas inlet conduit means being disposed in a common plane and defining a seat for said valve means.

2. A variable firing rate burner comprising:

(a) inlet means through which fuel and air flow, said inlet means including gas inlet means and air inlet means, said gas inlet means disposed within said air inlet means;

(b) valve means for controlling fuel/air ratio and the flow rate of said fuel and air flowing in said inlet means, said valve means movable between a first position and a second position, said fuel/air flow rate being greater at said second position than at said first position, said fuel/air ratio being maintained as said valve means is moved from said first position to second position;

(c) control means operatively connected to said valve means for moving said valve means to at least said first and second position;

(d) a chamber wherein said fuel and air are mixed; and (e) means for igniting said fuel and air mixture;

(f) said air inlet means being air inlet conduit means and said gas inlet means being gas inlet conduit means, said gas inlet means being tangentially mounted within said air inlet conduit means and said valve means mounted to said inlet means adjacent the point of tangency of said gas inlet means and said air inlet means.

3. The variable firing rate burner as claimed in claim 2 wherein said valve means includes a throttle plate pivotally mounted to said inlet means, said control means operative to move said throttle plate between a low firing rate position corresponding to said first position and high firing rate position corresponding to said second position.

4. The variable firing rate burner as claimed in claim 3 wherein said control means includes a driver having a reciprocating piston, said driver having energized and de-energized states, said piston in a first position when said driver is in said energized state, said piston in a second position when said driver is in a de-energized state, said throttle plate in said high firing rate position when said driver is in one of said energized and de-energized states, said throttle plate in said low firing rate position when said driver is in the other of said energized and de-energized states.

5. The variable firing rate burner as claimed in claim 2 wherein said control means includes a driver having a rotatable shaft and wherein said valve means includes a throttle plate, said throttle plate operatively connected to said shaft, said throttle plate movable between said first position which corresponds to a low firing rate postion and said second position which corresponds to a high firing rate position, said driver operative to move said throttle plate to said high firing rate position, said low firing rate position and intermediate firing rate positions between said high firing rate position and said low firing rate position, said fuel/air ratio remaining substantially constant at each said firing rate position.

6. The variable firing rate burner as claimed in claim 2 wherein said valve means includes a throttle plate which is pivotally mounted to said inlet means adjacent the point of tangency of said gas inlet conduit means and said air inlet conduit means.

7. A variable firing rate burner comprising:

(a) inlet means through which fuel and air flow, said inlet means including air inlet conduit means and gas inlet conduit means, outer edges of said air inlet conduit means and said gas inlet conduit means being disposed in a common plane, said gas inlet conduit means being tangentially mounted within said air inlet conduit means;

(b) valve means for controlling the fuel/air ratio and the flow rate of said fuel and air flowing in said inlet means, said valve means including a throttle plate pivotally mounted to said inlet means, the outer edges of said air inlet conduit means and said gas inlet conduit means defining a seat for said valve means, said valve means movable between a first position and a second position, said fuel/air flow rate being greater at said second position than at said first position, said fuel/air ratio being maintained as said valve means is moved from said first position to second position, said throttle plate being pivotally mounted to said inlet means adjacent the point of tangency of said gas inlet conduit means and said air inlet conduit means;

(c) control means operatively connected to said valve means for moving said valve means to at least said first and second positions;

(d) a chamber wherein said fuel and air are mixed; and (e) means for igniting said fuel and air mixture.

8. A variable firing rate combustion system comprising:

(a) inlet means through which fuel and air flow, said inlet means including gas inlet means and air inlet means, said gas inlet means tangentially mounted within said air inlet means;

(b) valve means for controlling fuel/air ratio and the flow rate of said fuel and air flowing in said inlet means, said valve means movable between a first position and a second position, said fuel/air flow rate being greater at said second position than at said first position, said fuel/air ratio being maintained as said valve means is moved from said first position to said second position;

(c) valve control means operatively connected to said valve means for moving said valve means to at least said first and second positions;

(d) blower means for drawing said fuel and air through said inlet means;

(e) a housing with a mixing chamber wherein said drawn fuel and air are mixed;

(f) a flameholder mounted to said housing, said fuel and air mixture flowing through said flameholder;

(g) ignitor means adjacent said flameholder for igniting said fuel and air mixture; and (h) burner control means operatively connected to and controlling said fuel/air valve control means, said blower means and said ignitor means.

9. A variable firing rate combustion system comprising:

(a) inlet means through which fuel and air flow, said inlet means including gas inlet conduit means and air inlet conduit means, said gas inlet conduit means tangentially mounted within said air inlet conduit means;

(b) valve means for controlling fuel/air ratio and the flow rate of said fuel and air flowing in said inlet means, said valve means including a throttle plate pivotally mounted to said inlet means adjacent the point of tangency of said gas inlet conduit means and said air inlet conduit means, said valve means movable between a first position and a second position, said fuel/air flow rate being greater at said second position than at said first position, said fuel/air ratio being maintained as said valve means is moved from said first position to said second position;

(c) valve control means operatively connected to said valve means for moving said valve means to at least said first and second positions, said valve control means operative to move said throttle plate between a low firing rate position corresponding to said first position and high firing rate position corresponding to said second position;

(d) blower means for drawing said fuel and air through said inlet means;

(e) a housing with a mixing chamber wherein said drawn fuel and air are mixed;

(f) a flameholder mounted to said housing, said fuel and air mixture flowing through said flameholder;

(g) ignitor means adjacent said flameholder for igniting said fuel and air mixture; and (h) burner control means operatively connected to and controlling said fuel/air valve control means, said blower means and said ignitor means.

10. The variable firing rate combustion system as claimed in claim 9 wherein said valve control means includes driver means having a reciprocating piston, said driver means having energized and de-energized states, said piston in a first position when said driver is in said energized state, said piston in a second position when said driver is in a de-energized state, said throttle plate in said high firing rate position when said driver is in one of said energized and de-energized states, said throttle plate in said low firing rate position when said driver is in the other of said energized and de-energized states, the fuel/air ratio at said high firing rate being substantially the same fuel/air ratio at said low firing rate.

11. The variable firing rate combustion system as claimed in claim 9 wherein said valve control means includes a driver having a rotatable shaft and wherein said valve means includes a throttle plate, said throttle plate operatively connected to said shaft, said throttle plate movable between said first position which corresponds to a low firing rate position and said second position which corresponds to a high firing rate position, said driver operative to move said throttle plate to said high firing rate position, said low firing rate position and intermediate firing rate positions between said high firing rate position and said low firing rate position, said fuel/air flow rate increasing as said throttle plate is moved from said low firing rate position to said high firing rate position, said fuel/air ratio remaining substantially constant at each said firing rate positions.

* * * * *